United States Patent [19]

Paulitsch et al.

[11] 4,180,418

[45] Dec. 25, 1979

[54] METHOD OF MAKING A STEEL WIRE ADAPTED FOR COLD DRAWING

[75] Inventors: Hans Paulitsch, Salzgitter-Lebenstedt; Alfred Babilon, Salzgitter; Gerhard Kiefer; Kurt Koerfer, both of Salzgitter-Lebenstedt; Constantin Vlad, Wolfenbüttel; Ullrich Koch, Salzgitter-Lebenstedt, all of Fed. Rep. of Germany

[73] Assignee: Stahlwerke Peine-Salzgitter A.G., Peine, Fed. Rep. of Germany

[21] Appl. No.: 829,815

[22] Filed: Sep. 1, 1977

Related U.S. Application Data

[63] Continuation-in-part of Ser. No. 683,783, May 6, 1976, abandoned, which is a continuation of Ser. No. 503,815, Sep. 6, 1974, abandoned.

[30] Foreign Application Priority Data

Sep. 11, 1973 [DE] Fed. Rep. of Germany ..... 2345738

[51] Int. Cl.[2] ..... C21D 9/52

[52] U.S. Cl. ..... 148/12.4; 148/12 B

[58] Field of Search ..... 148/12 B, 12.4

[56] References Cited

U.S. PATENT DOCUMENTS

| | | | |
|---|---|---|---|
| 3,756,870 | 9/1973 | Kasper et al. | 148/12.4 |
| 4,016,009 | 4/1977 | Economopoulos et al. | 148/12 B |
| 4,016,015 | 4/1977 | Respen et al. | 148/12.4 |
| 4,042,423 | 8/1977 | Van den Sype | 148/12 B |

*Primary Examiner*—W. Stallard

*Attorney, Agent, or Firm*—Michael J. Striker

[57] ABSTRACT

A steel wire after coming from the mill is brought to a temperature between 850° and 910° C. This is followed by multi-stage water-cooling of the wire in such a manner that the surface of the wire is cooled to below the martensite start temperature while austenite is retained in the core of the wire. The heat retained in the core of the wire serves to partially temper the martensite formed at the surface of the wire. The wire is coiled while the temperature remains substantially constant so that the retained austenite in the core of the wire undergoes an isothermal transformation to fine pearlite. The heat of transformation serves to complete tempering of the martensite. After coiling, the wire is air-cooled to room temperature. The final wire exhibits a structure consisting of an outer layer of tempered martensite and a core of fine pearlite. This structure imparts excellent cold-working characteristics to the wire.

11 Claims, No Drawings

METHOD OF MAKING A STEEL WIRE ADAPTED FOR COLD DRAWING

CROSS-REFERENCE TO RELATED APPLICATIONS

This application is a continuation-in-part of earlier copending application Ser. No. 683,783, filed May 6, 1976, which in turn was a continuation of earlier copending application Ser. No. 503,815, filed Sept. 6, 1974, both of which are now abandoned.

BACKGROUND OF THE INVENTION

The invention relates generally to a method for making steel articles having a core which contains pearlite and an outer surface of martensite.

In order to produce high-strength wires for cables, carbon-rich steel wires are cold-drawn by passing them through a series of dies of continuously decreasing size. As a starting material, it is requisite to use wires which possess not only high strength but which also have good cold-working characteristics.

The high strength of the wires is necessary so that the forces generated during the drawing operation may be transmitted along the wire whereas the good cold-deformability is intended to prevent cracking or tearing during the drawing operation. These necessary characteristics were, according to the prior art, achievable only when the microstructure of the entire steel wire consisted of fine pearlite with no more than small amounts of ferrite segragation. Such microstructure could only be produced when the wire, which was normally hot-rolled prior to being cold-drawn, was subjected to an additional heat treatment after being cooled to room temperature. This heat treatment is the so-called patenting treatment. Without it the hot-rolled wire, was not well-suited for an immediately following cold-deformation, and could be subject only to relatively low reductions in area, that is, between 35 and 50 percent.

The patenting treatment usually is applied to wires having dimensions smaller than 13 millimeters and mostly consists of reheating the wires into the austenitic range and then rapidly cooling the wires to a temperature below 500° C. in a lead bath or salt bath. The wire is held at this temperature for a period of at least 10 seconds. All of the carbon in the wires is in solution in the austenite retained during the cooling and, by virtue of the isothermal transformation of the retained austenite at this temperature, there is obtained fine pearlite having outstanding drawing characteristics.

Although the patenting treatment leads to an improvement in the drawing characteristics of the wires, there has been a problem associated with the use of this treatment. This resides in the fact that the patenting arrangements using lead or salt baths have a relatively low capacity of 1.8 to 3 tons per hour whereas the continuous wire rolling mills have a capacity of over 40 tons per hour. Thus, it has not been possible to effectively integrate these patenting arrangements with the rolling procedure.

A direct patenting of steel wire making use of the heating required for hot-rolling has already been proposed some time ago in the U.S. Pat. Nos. 1,232,014 and 1,295,139. However, it has only been quite recently that three arrangements have been developed which are practical to use and which have been introduced into service. These arrangements are manufactured, respectively, by the Stelmore Company of Canada, the Demag-Yawata Company of Germany and the Schloemann Company of Germany.

All three arrangements have in common that the wire is precooled in a water quenching stage after leaving the last stage of the hot-rolling mill and is subsequently cooled to a temperature below the transformation temperature for fine pearlite. In these arrangements, the wire is cooled to below the transformation temperature in extended form rather than first being wound into the form of a coil as is conventional. It is only after being so cooled that the individual windings are assembled and shaped into the form of rings in a coil assembly station. The formation of fine pearlite is achieved with each of the three arrangements. On the other hand, all of the arrangements possess the disadvantage that high capital investment costs are associated therewith.

A method of producing wire wherein the wire is wound into the form of a coil and then cooled is proposed in the U.S. Pat. No. 2,756,169. Here, the wire leaves the last hot-rolling stage at a temperature of 982° C. and is cooled to a temperature between 482° and 750° C. in a period of 1.5 seconds by being passed through a multi-step water quenching stage. The wire is then coiled and thereafter cooled to room temperature in air. During the air-cooling the heat loss resulting from the cooling is, for a short period of time, compensated for by the heat of transformation which is released so that the wire undergoes a substantially isothermal transformation to pearlite. In this method, which has strong similarity to the lead bath patenting procedure, it is, however, recommended that the water-cooling not drive the temperature of the wire below 482° C. This is based on the fact that cooling of the wire to below this temperature results in an intermediate stage, namely, a martensitic transformation. The reason presented for not cooling the wire to below 482° C. is that this would again substantially worsen the drawing characteristics of the wire. In any event, the method according to the U.S. Pat. No. 2,756,169 has a certain disadvantage associated with it. This resides in that, for the rolling speeds conventionally used and, in particular, for the rolling speeds which it is attempted to achieve in the future, the multi-step cooling of the wire while it is in extended or linear form in the manner proposed in this patent results in quenching stages having an unacceptably great length.

The U.S. Pat. No. 3,011,928 proposes a method for use with the conventional continuous wire-rolling mills which enables quenching stages of shorter length to be utilized. The wire, which leaves the rolling mill at 982° C., is here initially cooled with water to between 733° and 788° C. and is subsequently coiled. The wire is further cooled to a temperature between 482° and 705° C. and, in particular, to a temperature between 533° and 663° C., in a period of about one minute by passing it through a misty atmosphere, that is, an atmosphere consisting of water vapor in air. This additional cooling is carried out either during passage of the wire to the spool or in the spool itself. This method, however, has the disadvantage that the individual windings of the wire in the coil undergo non-uniform cooling so that a consistent microstructure along the length of the wire cannot be insured.

It is, accordingly, a general object of the invention to provide a novel method of producing steel articles possessing drawing characteristics which are at least as good as those of the steel wires produced according to the prior art and which, at the same time, possess higher strength than the steel wires of the prior art.

A further object of the invention is to provide a process for making steel wires possessing good characteristics and strength by which process the articles may be produced more simply and economically than was possible heretofore and which requires less capital investment than the arrangements utilized until now.

It is also an object of the invention to provide a process for making steel wires possessing good drawing characteristics and strength by using shorter quenching stages than could be used heretofore.

SUMMARY OF THE INVENTION

These objects are achieved by a process wherein the hot rolled wire is brought to a temperature between about 850° and 910° C. so as to obtain a fine grain austenite structure in the wire. The wire is then subjected to the quenching to bring its temperature down to about 500° C. Coiling of the wire is effected after the quench. The quench is carried out in a manner that a transformation to martensite occurs only within a limited outer surface of the wire not to exceed 33% of the cross-sectional area of the wire. The substantially higher temperature of the core then causes a substantially isothermal transformation of the austenite of the core to pearlite with only a small portion of ferrite and furthermore causes a tempering of the martensite surface portion. The wire is finally permitted to slowly cool to atmospheric temperature.

There is thus obtained a product which has a martensite outer surface of a specific maximum diameter as indicated and an inner core of fine grain pearlite. The product thus has a temper gradient from the surface to the core.

Although it will be appreciated that regions of mixed microstructure may exist, a steel wire made by the method of the invention may be viewed as being basically composed of a core and a surface layer which substantially completely encloses the core. It is favorable for the core to consist entirely or almost entirely of pearlite and for the surface layer to consist entirely or almost entirely of martensite. The martensitic layer may thus form the outer surface or, at least, the major part of the outer surface, of the wire.

In accordance with a particularly advantageous embodiment of the invention, the pearlite in the core is in the form of fine pearlite and the martensite in the surface layer is in the form of fully tempered martensite. It is of further advantage when the depth of the martensite layer is such that the cross-sectional area thereof is equal to about 33 percent of the overall cross-sectional area of the wire at a maximum.

The finding according to the invention as outlined above is surprising and totally unexpected. Thus, as indicated by the numerous publications in the field of the invention, the prior art was unanimously of the view that the formation of martensite had to be avoided under all circumstances if a wire having good drawing characteristics was to be obtained. The novel steel wire, which is developed in the face of this generally held view, possesses outstanding drawing characteristics and, surprisingly, has a higher strength than comparable known steel wires. Consequently, high drawing forces may be carried by or transmitted along the wire. Tempered martensite having a hardness equivalent to that of fine pearlite exhibits drawing characteristics which are equally as good as those of the latter. However, as just mentioned, the cross-sectional area of the martensitic layer must not exceed about 33 percent of the cross-sectional area of the wire.

The core of the novel steel wire advantageously still contains a maximum of only about 1 percent of segregated ferrite, that is, ferrite other than that contained in the pearlite. By virtue of a reduction of the segregated ferrite content to such a value, an increase in the reduction of the overall cross-sectional area may be achieved even though tempered martensite is present in the outer surface of the wire. The novel steel wire exhibits a reduction of its overall cross-sectional area during cold-drawing which advantageously amounts to 85 percent at a minimum so that a steel wire in accordance with the invention may be one that has undergone a cold-reduction in its cross-sectional area of at least 85 percent.

DISCUSSION OF THE INVENTION AND OF PREFERRED EMBODIMENTS

Thus, there is provided a method of producing a steel wire, having a core which contains pearlite and a surface which contains martensite wherein a steel wire is heated at least substantially to the austenitic region. The wire is cooled in such a manner that a surface portion thereof is cooled below the martensite start temperature so as to transform to martensite, i.e. is quenched, while a core portion thereof retains austenite. The wire is treated so as to effect at least partial transformation of the retained austenite in the core portion into pearlite.

It is advantageous when, prior to cooling the surface of the wire to below the martensite start temperature, the wire has temperatures in the range of about 850° to 910° C., in order to obtain a five grain austenite in the wire before its surface transforms to martensite in the multiple cooling station. Cooling of the surface of the wire from the temperature range of about 850° to 910° C. to below the martensite start temperature is preferably effected in approximately 0.2 seconds. The cooling of the surface of the wire to below the martensite start temperature may be carried out using multi-stage water-cooling of the wire. The multiple stage cooling of the wire in which the surface regions of the wire are only transformed to martensite consists of a series of water sprays so arranged that after each cooling stage the initially formed martensite is partially tempered through the heat losses of the wire core. The arrangements of the cooling sprays are such that the surface portion of the tempered martensite does not exceed a maximum of about 33 percent of the cross-sectional area of the wire.

The wire may be hot-worked or hot-rolled when it is in the austenitic region. Advantageously, the wire is coiled during the treating step. The transformation of the retained austenite into pearlite may, at least in part proceed substantially isothermally and it is of advantage when the coiling and such isothermal transformation are at least approximately concurrent. The wire may be cooled further after coiling and is favorably cooled to about room temperature. Preferably, this cooling is carried out in the atmosphere.

Advantageously, the transformation of the retained austenite into pearlite proceeds to completion. After the treating step, the wire may be cold-worked or cold-drawn. It is particularly favorable when a reduction of at least 85 percent in the cross-sectional area of the wire is effected during the cold-working operation.

As mentioned above, the wire may be subjected to hot-working such as, for instance, hot-rolling, when it is heated to the austenitic region. Of particular interest to the invention is a method wherein the heating required for the hot-rolling may be utilized.

The novel method for the production of steel wires using the heating required for hot-rolling is based on the earlier method known from U.S. Pat. No. 2,756,169. According to this patent, the steel wire is hot-rolled and, after leaving the finishing stage of the wire rolling mill, is subjected to a multi-stage water-cooling operation. Subsequently, the wire is wound into the form of a coil and, thereafter, cools to room temperature in free air.

According to the invention, it is now contemplated to bring the steel wire to a temperature of about 850° to 910° C. prior to the multi-stage water-cooling operation, and to subsequently cool, i.e. quench, the outer surface of the wire to below the martensite start temperature using multi-stage cooling. The multi-stage cooling is preferably carried out using water and the cooling of the surface of the wire to below the martensite start temperature is preferably effected in about 0.2 seconds.

To cool the surface of the wire, it is possible, for example, to convey the wire at a rate of about 40 meters per second through a water-quenching stage having a length of approximately 8 meters. In accordance with the novel method, the region of the outer surface of the wire is thus cooled to below the martensite start temperature in a very short period of time, that is, is quenched to below the martensite start temperature. As a result, martensite forms in the region of the outer surface of the wire during the water-cooling. On the other hand, austenite is retained in the core of the wire, in other words, the quench is carried out in such a manner that a martensitic transformation does not occur in the core of the wire. Further in accordance with the invention, the heat retained in the core of the wire during the quench is thus subsequently used for tempering the martensite formed in the region of the outer surface of the wire during the quench. After quenching, the wire may be coiled. Since the quenching of the outer surface of the wire takes place in a short time interval which preferably approximates 0.2 seconds, the wire is composed, at the time that it enters the coiling arrangement or reel, of an incompletely tempered martensitic layer in the region of the outer surface thereof and of a core which is in the form of undercooled austenite containing carbon in solution.

It is preferred that the steel wire be brought into the reel as soon as possible after having passed through the quenching stage. In carrying out the method, it is preferred for the temperature of the wire at the end of the coiling operation to be always so selected that a transformation temperature of approximately 500° C. is obtained in the reel. When these conditions are satisfied, the undercooled austenite in the core of the wire undergoes a transformation to fine pearlite during the coiling operation and in the reel itself. As a result of the heat of transformation which is released, not only are the heat losses which occur by virtue of the air-cooling of the wire compensated for during a short time interval but, in addition, the wire is heated to a temperature which is about 50° C. in excess of that with which it entered the reel. Consequently, the core of the wire undergoes an approximately isothermal transformation in the pearlite formation stage. Simultaneously, the martensite present in the region of the outer surface of the wire becomes fully tempered.

The air-cooling of the wire which has begun during the coiling operation is favorably continued so that the wire air-cools to room temperature after it is coiled. The wire may thereafter be cold-drawn.

A wire produced in the manner described possesses a tempered martensitic layer in the region of the outer surface thereof. The core of the wire contains fine pearlite and a segregated ferrite content of less than 1 percent may be achieved in the core of the wire. Another advantage obtainable with the invention resides in the fact that the steel wire produced in this manner exhibits less scaling than conventionally produced steel wires.

Moreover, of substantial significance as regards the capital investment expenditures relating to the apparatus required for carrying out the method of the invention, as well as regards the surface area required for the apparatus, is the fact that it is no longer necessary to spread out the rolled wire to individual windings for cooling purposes as has been necessary in methods used heretofore. Since, in addition, the multistage water-cooling operation need require only about 0.2 seconds, the apparatus may have quenching stages which are substantially shorter than those used conventionally.

The following Example, which indicates the results achievable with the invention, is not intended to limit the invention in any manner:

EXAMPLE

A billet 83×83 millimeters in cross-section of D 45-2 steel (German Standard DIN 17 140) after being austenized to about 1 150° to 1 180° C. in a continuous furnace is being hot rolled to wire having a diameter of 5.5 millimeters using the method of the invention. The wire bar has the following chemical composition in terms of weight percent:

Carbon—0.48
Manganese—0.50
Silicon—0.29
Phosphorus—0.008
Sulfur—0.024
Nitrogen—0.0050
Iron—Remainder After leaving the finishing stage of the wire rolling mill, and immediately before entering the multi-step water-cooling stage, the wire has an outer surface temperature of 860° C. The cooling or quenching stage is then operated using water in an amount of 110 cubic meters per hour. The wire passes through the quenching stage in 0.2 seconds. The transformation temperature of the wire in the reel is thus approximately 500° C. No after-blowing is effected in the reel. It has been found that, in the production of wire according to the novel method, a further improvement in the drawing characteristics may be achieved through elimination of a subsequent cooling of the coil in the reel by blowing in of air.

The wire produced in this manner possessed the following properties:

| Technological Properties Over the Length of the Coil | |
|---|---|
| Yield strength | 61 to 71 kp per square millimeter |
| Tensile Strength | 87 to 96 kp per square millimeter |

-continued

| Technological Properties Over the Length of the Coil | |
|---|---|
| Reduction in Area | 57 to 65 percent |

| Reduction in Overall Cross-Sectional Area During Drawing Without Cracking of the Wire |
|---|
| 85.4 percent |

| Microstructure | |
|---|---|
| At the edge | :Fully tempered martensite having a thickness of 0.40 to 0.45 millimeters |
| In the core | :Fine pearlite and approximately 1 percent segregated ferrite. |

It will be understood that each of the elements described above, or two or more together, may also find a useful application in other types of methods differing from the types described above.

While the invention has been illustrated and described as embodied to a specific method of making a steel wire, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process of making a steel wire of high strength and good cold drawing properties, the said process comprising (a) after hot rolling the wire bringing it to a temperature between about 850° and 910° C. so as to obtain a fine grain austenite structure in the wire;

(b) thereafter quenching the wire to cool it to a temperature of about 500° C.;

(c) coiling the wire after said quench and finally cooling it to room temperature, the said quench being carried out in a manner that a transformation to martensite occurs which is limited to the outer surface of the wire not to exceed 33 percent of the cross sectional area of the wire, the still substantially higher temperature of the core after the quench causing a substantially isothermal transformation of the austenite of the core to pearlite with only a small fraction of ferrite and further causing a tempering of the martensite surface portion, whereby a product with a martensite outer surface of the said maximum diameter and an inner core of pearlite is obtained having a temper gradient from the surface to the core.

2. The process of claim 1 wherein the quench time amounts to about 0.2 seconds.

3. The process of claim 1 wherein the quench is carried out in a multi-stage water cool, after each stage the front martensite portion being subjected to said tempering.

4. The process of claim 1 wherein the water quench is effected by moving the wire at a speed of about 40 m/sec. through a water quench stage of a length of about 8 m.

5. The process of claim 1 wherein the segregated ferrite of the steel is limited to 1 percent.

6. The process of claim 1 wherein the finished wire is subjected to a cold drawing resulting in a cross-sectional reduction of at least about 85 percent.

7. The process of claim 1 wherein the final cooling of the coiled wire is effected without forced air flow.

8. The process of claim 1 wherein the coiling of the wire is effected while the outer surface of the wire is still an imcompletely tempered martensite layer while the core is still in the form of undercooled austenite containing carbon in solution, further tempering of the martensite surface and further transformation of the undercooled austenite core to pearlite taking place thereafter while the coiled wire is on the reel.

9. The process of claim 1 wherein the wire in the rolling mill is rolled to a diameter of 5.5 mm.

10. The process of claim 1 wherein the wire has the following composition in percentages by weight: carbon 0.48, manganese 0.50, silicon 0.29, phosphorus 0.008, sulfur 0.024, nitrogen 0.0050, remainder iron.

11. The process of claim 1 wherein the wire of a D45-2 steel according to German Standard DIN 17140 has a yield strength of at least 61 kp per square millimeter.

* * * * *